US006568321B2

(12) United States Patent
Sakamoto

(10) Patent No.: US 6,568,321 B2
(45) Date of Patent: May 27, 2003

(54) SCREEN PRINTER AND A METHOD FOR SETTING A SCREEN PLATE

(75) Inventor: Toshio Sakamoto, Chiba (JP)

(73) Assignee: Micro-Tec Company, Ltd., Chiba (JP)

( * ) Notice: Subject to any disclaimer, the term of this patent is extended or adjusted under 35 U.S.C. 154(b) by 0 days.

(21) Appl. No.: 09/887,007

(22) Filed: Jun. 25, 2001

(65) Prior Publication Data

US 2002/0124741 A1 Sep. 12, 2002

(30) Foreign Application Priority Data

Mar. 12, 2001 (JP) ..... 2001-068029

(51) Int. Cl.[7] ..... B05C 17/06

(52) U.S. Cl. ..... 101/126; 101/DIG. 36; 101/486; 33/620

(58) Field of Search ..... 101/123, 126, 101/DIG. 36, 485, 486; 33/614, 617, 619, 620, 621

(56) References Cited

U.S. PATENT DOCUMENTS 3,943,851 A * 3/1976 Inada et al. ..... 101/127.1
4,833,985 A * 5/1989 Kojima et al. ..... 101/401.1
4,872,407 A * 10/1989 Banke ..... 101/389.1
5,168,805 A * 12/1992 Kasanami et al. ..... 101/128.21
5,459,941 A * 10/1995 Lowe ..... 101/481
5,752,446 A * 5/1998 Squibb ..... 101/126
5,806,424 A * 9/1998 Elliot ..... 101/115
5,901,646 A * 5/1999 Walker et al. ..... 101/123
5,970,867 A * 10/1999 Barozzi ..... 101/126
6,036,994 A * 3/2000 Tanaka et al. ..... 101/126
6,338,297 B1 * 1/2002 Wang et al. ..... 101/126

FOREIGN PATENT DOCUMENTS

JP 08-118592 5/1996

* cited by examiner

*Primary Examiner*—Ren Yan
(74) *Attorney, Agent, or Firm*—Birch, Stewart, Kolasch & Birch, LLP

(57) ABSTRACT

Laser beams 94 and 95 of laser emitters 74 and 75 are applied to work positioning marks 54 and 55 vertically before attaching a screen plate 60. Then, for attaching the screen plate 60 to frame fixing units 66 and 67, the screen plate 60 is fixed to the frame fixing units 66 and 67 so that the laser beams 94 and 95 are applied to plate positioning marks 64 and 65.

15 Claims, 3 Drawing Sheets

SCREEN PRINTER AND A METHOD FOR SETTING A SCREEN PLATE

BACKGROUND OF THE INVENTION

1. Field of the Invention

This invention relates to a positioning operation for attaching a screen plate including a frame and a screen to a screen printer. The screen plate might be also called as a stencil plate, stencil sheet, screen-mesh, etc.

2. Description of the Related Art

FIG. 5 explains an operation of attaching a screen plate according to the related art.

In FIG. 5, a work 53 is placed on a table 51. Work positioning marks 54 and 55 are written on the work 53. A screen plate 60 includes a frame 61 and a screen 63. The screen plate 60 is attached to frame fixing units 66 and 67 so that plate positioning marks 64 and 65 written on the screen 63 respectively correspond to the work positioning marks 54 and 55. In the related art, the plate positioning mark 64 and the work positioning mark 54 were matched and the plate positioning mark 65 and the work positioning mark 55 were matched just by looking with eyes. After the screen plate 60 was attached, printing for trial was repeated a few times to make a minor adjustment in an attaching position of the screen plate 60. In this way, the attaching position of the screen plate 60 was determined.

SUMMARY OF THE INVENTION

The screen 63 is a screen-mesh, or the screen 63 is made of a metal. Therefore, even if positioning is tried from a position above the screen 63, it is impossible to look at the work positioning marks 54 and 55 which are under the screen 63. Therefore, positioning was performed only by guessing, and it was necessary to print for trial a few times after positioning. The positioning was performed by trial and error.

It is one of objects of this invention to provide a screen printer and a method for setting the screen plate in which the screen plate is able to be attached at a right position in a stage of initializing the screen printer, i.e., so-called alignment stage.

According to an aspect of this invention, a screen printer for performing screen printing by matching positions of a work and a screen plate includes a pointing unit for pointing at a work positioning mark on a work by a pointer. A plate positioning mark on the screen plate is positioned to be matched with the pointer of the pointing unit once the work positioning mark has been pointed by the pointer of the pointing unit.

According to another aspect of this invention, a method for setting a screen plate includes setting a work at a printing position, pointing a light beam at a work positioning mark on the work, and setting a position of the screen plate to match a plate positioning mark on the screen plate with the light beam.

According to another aspect of this invention, the screen printer includes a table for placing a work including a work positioning mark, a pointing unit for pointing by a pointer at the work positioning mark on the work placed on the table, and a fixing unit for fixing a screen plate including a plate positioning mark to be positioned for being matched with the pointer of the pointing unit pointing at the work positioning mark.

Further features and applications of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Other objects features, and advantages of the invention will be apparent from the following description when taken in conjunction with the accompany drawings.

DETAILED DESCRIPTION OF THE PREFERRED EMBODIMENTS

Embodiment 1.

Figure 1:
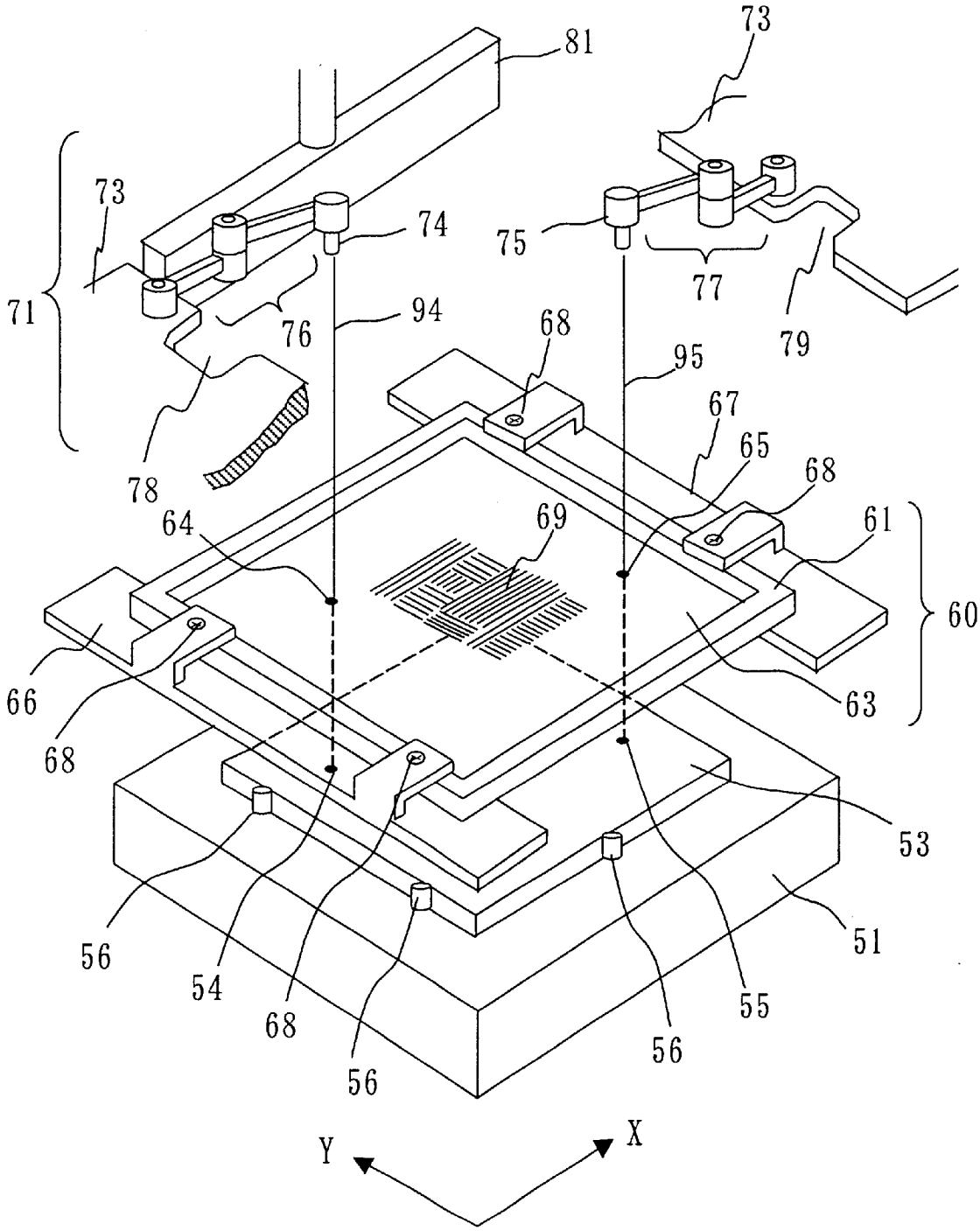
FIG. 1 illustrates positioning of the screen plate 60.

FIG. 1 illustrates an operation of positioning a screen plate by using a laser beam. The screen plate might be also called as a stencil plate, stencil sheet, screen-mesh, etc.

In FIG. 1, the work 53 is placed on the table 51. The work 53 is positioned by a work positioning pin 56. It is also possible to position the work 53 on the table 51 by another positioning mechanism, e.g., sucker, etc. The work positioning marks 54 and 55 are provided on the work 53 in advance. It is desirable that there are two work positioning marks. It is also desirable that the marks are on a diagonal line of the work.

The screen plate 60 includes the frame 61 and the screen 63. A print pattern 69 is provided almost at a center of the screen 63. Further, the plate positioning marks 64 and 65 are provided on the screen 63. The screen plate 60 is attached to the frame fixing units 66 and 67 by corresponding the plate positioning mark 64 to the work positioning mark 54 and corresponding the plate positioning mark 65 to the work positioning mark 55. The frame fixing units 66 and 67 fix the frame 61 of the screen plate 60 by using a fixing screw 68. However, another kind of fixing method may be used.

A printing unit 71 (an example of a pointing unit) operates the squeegee 81, and prints. An XY movable arm 76 is attached to a frame 73 of the printing unit 71, and the laser emitter 74 is provided at an end of the XY movable arm 76. Similarly, the laser emitter 75 is attached to an opposite frame 73 through an XY movable arm 77. Housing units 78 and 79 are provided in the frame 73. When the laser emitters 74 and 75 are not used, the laser emitters 74 and 75 are stored in the housing units 78 and 79 to avoid preventing a motion of the squeegee 81.

The XY movable arms 76 and 77 position the laser emitters 74 and 75 in X-Y directions, i.e., the XY movable arms 76 and 77 position the laser emitters 74 and 75 freely on a plane parallel with a printing surface. The laser emitters 74 and 75 can be moved manually.

Figure 2:
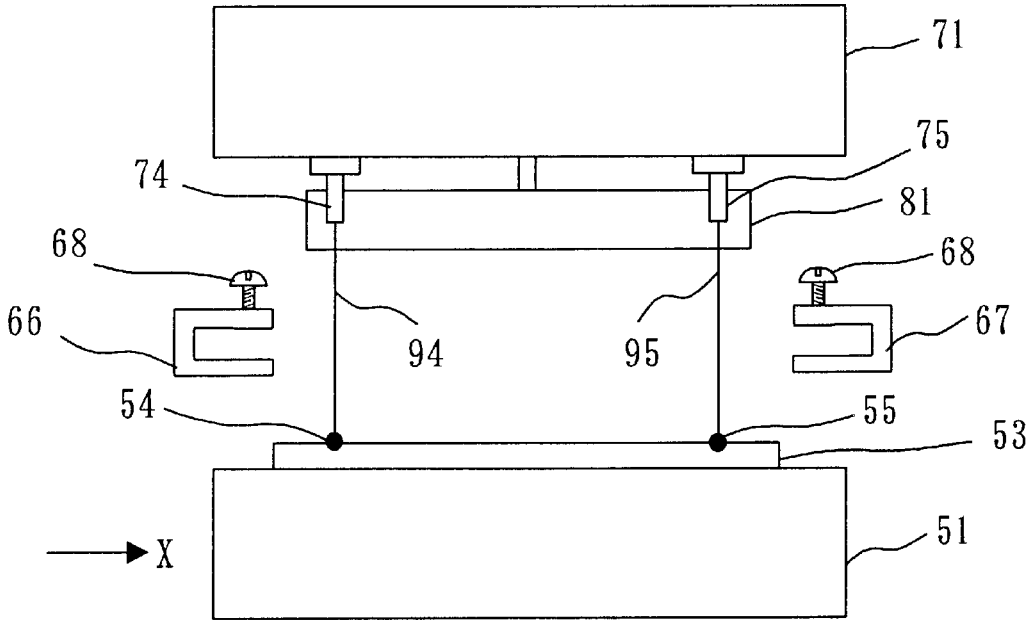
FIG. 2 illustrates an operation for pointing a laser beam 94 of a laser emitter 74 and a laser beam 95 of a laser emitter 75 at the work 53.
Figure 3:
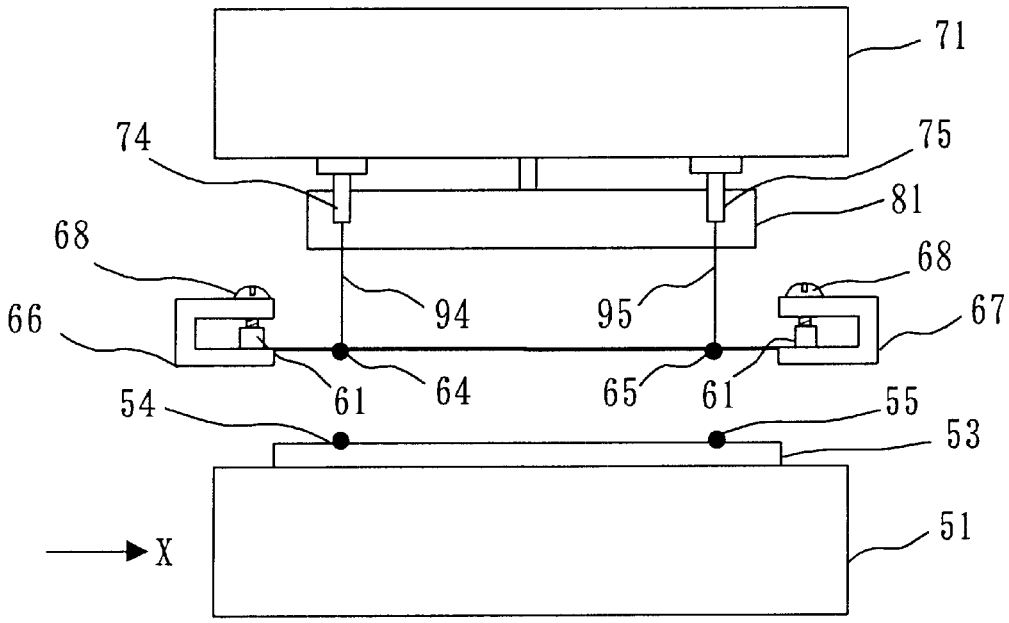
FIG. 3 illustrates an operation for pointing the laser beam 94 of the laser emitter 74 and the laser beam 95 of the laser emitter 75 at the plate positioning marks 64 and 65.
Figure 4:
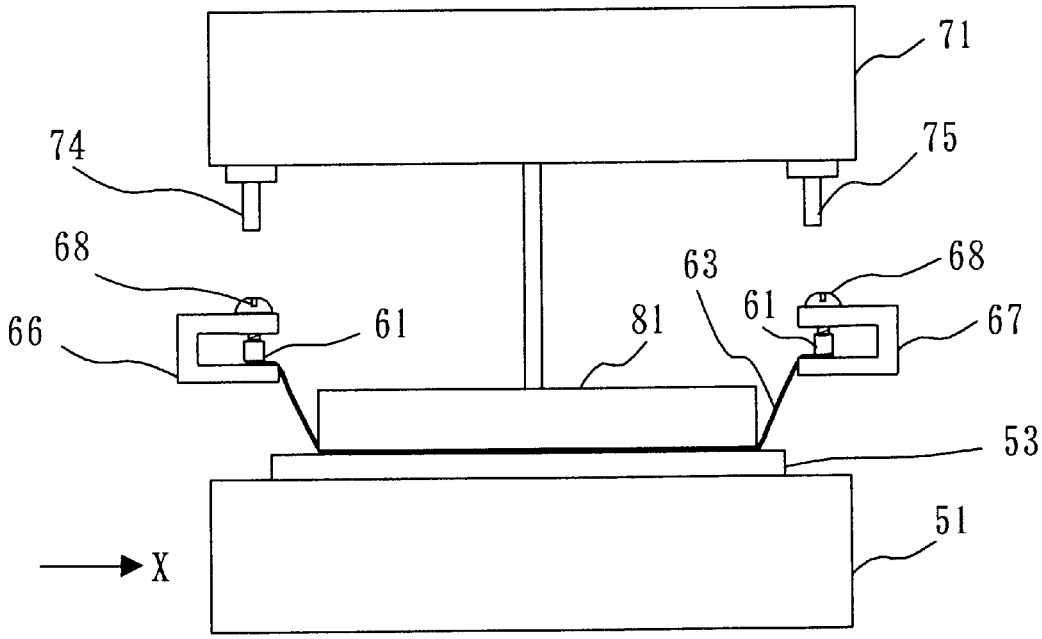
FIG. 4 illustrates a printing operation by a squeegee 81.
Figure 5:
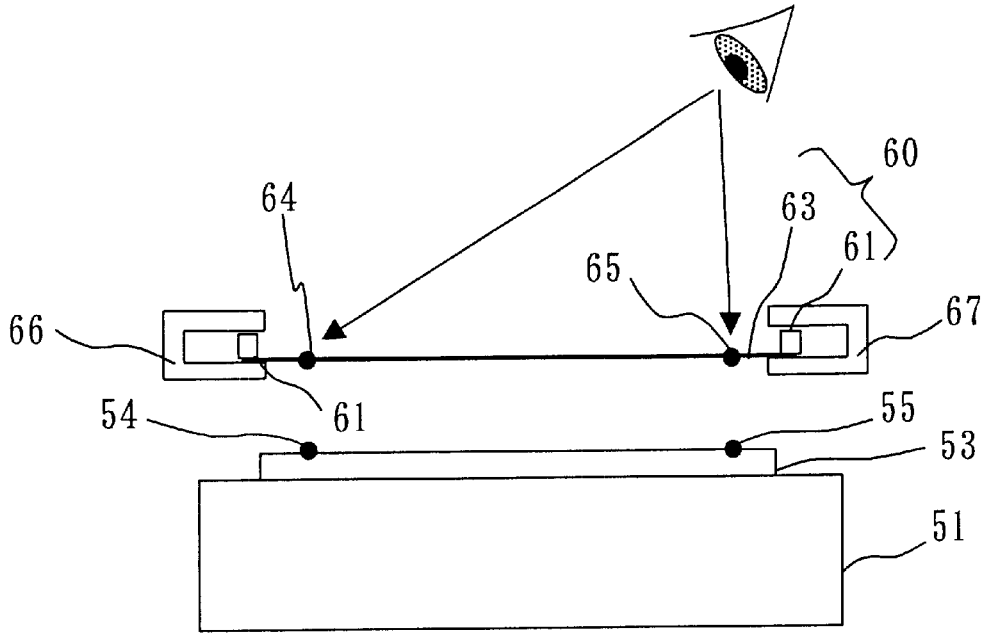
Fig. 5 RELATED ART
FIG. 5 illustrates a positioning operation of the screen plate according to the related art.

With reference to FIGS. 2–4, operations are explained.

In FIG. 2, the screen plate 60 has not been attached, yet.

The laser emitter 74 applies the laser beam 94 vertically to the work 53. Then, the XY movable arm 76 is moved so that the laser beam 94 (an example of a pointer) is exactly applied to the work positioning mark 54. Similarly, the XY movable arm 77 is moved for positioning the laser emitter 75 so that the laser beam 95 (an example of a pointer) is exactly applied to the work positioning mark 55.

FIG. 3 illustrates a state in which the screen plate 60 is attached to the frame fixing units 66 and 67 in FIG. 2.

The screen plate 60 is inserted to the frame fixing units 66 and 67 for allowing the screen plate 60 to slide in X-Y directions. The screen plate 60 is positioned so that the laser beam 94 is applied to the plate positioning mark 64 and the laser beam 95 is applied to the plate positioning mark 65. In this state, the fixing screw 68 is fastened, and the screen plate 60 is fixed to the frame fixing units 66 and 67. The work positioning mark 54 and the plate positioning mark 64 are matched and the work positioning mark 55 and the plate positioning mark 65 are matched by the laser beams 94 and 95 vertically applied to the work 53 or the screen plate 60. According to this configuration, it becomes unnecessary to position by guessing and print for trial. Consequently, it becomes possible to position the screen plate 60 quickly within an error of a few millimeter. It is even possible to reduce the error to 1 millimeter or less.

FIG. 4 illustrates a state of printing by the squeegee 81.

During printing, the laser emitters 74 and 75 are stored in the housing units 78 and 79. Therefore, the laser emitters 74 and 75 are not in a route of reciprocating motion of the squeegee 81, and the laser emitters 74 and 75 do not prevent a printing operation.

Stated embodiment is applied to a case of attaching the screen plate 60, i.e., so-called setup (alignment). When printing on a plurality of works 53 is performed consecutively, a video camera, which is not illustrated, is used for positioning. Positioning of the screen plate 60 is also possible by a positioning unit of the table 51, etc. As stated earlier, during printing consecutively, the laser emitters 74 and 75 are stored not to prevent printing.

Embodiment 2.

In Embodiment 1, a judgement is made if the laser beams 94 and 95 are respectively applied to the marks by looking. However, it is also possible to provide a sensor at each of the marks on the work and the screen plate and a reporting unit for reporting that positioning is right when the sensor detects one of the laser beams 94 and 95.

In Embodiment 1, the XY movable arm is moved manually. However, it is also possible to position by moving the XY movable arm by a drive mechanism using a motor (an example of a moving mechanism), scanning the XY plane, and detecting a signal from the reporting unit. It is also possible to detect a position automatically. Further, it is also possible to position by moving the screen plate 60 by a drive mechanism using a motor (an example of a moving mechanism), scanning the XY plane, and detecting a signal from the reporting unit.

In Embodiment 1, the laser beam is used as the pointer. However, another kind of light, e.g., infrared rays, spot light, etc. can be also used. It is also possible to use a pointing unit including another kind of pointer indicating a position.

As stated, according to this invention, the screen plate 60 can be positioned easily, accurately, and quickly.

According to this invention, it becomes unnecessary to print for trial for positioning the screen plate 60.

Further, according to this invention, the XY movable arm or the screen plate 60 can be positioned automatically.

Further, according to this invention, positioning can be confirmed from one direction. Further, since it is not necessary to consider about other directions, an apparatus design becomes efficient.

Having thus described several particular embodiments of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is limited only as defined in the following claims and the equivalents thereto.

What is claimed is:

1. A screen printer for performing screen printing by aligning positions of a workpiece and a screen plate, comprising:

a pointing unit aligning a pointing element with a work positioning mark provided on a workpiece, wherein a plate positioning mark on the screen plate is positioned to be aligned with the pointing element of the pointing unit once the work positioning mark has been aligned with the pointing element.

2. The screen printer of claim 1, wherein the pointing unit includes a movable arm for moving the pointing element in two-dimensional directions.

3. The screen printer of claim 1, wherein the pointing unit uses a light beam as the pointing element, the light beam being vertical with the printing surface.

4. The screen printer of claim 1, wherein the pointing unit points at two or more positions.

5. The screen printer of claim 1 further comprising:

a sensor provided at the plate positioning mark on the screen plate for detecting the pointing element from the pointing unit; and a reporting unit for reporting a positioning state of the screen plate based on a signal from the sensor.

6. The screen printer of claim 5 comprising a moving mechanism for moving the screen plate based on the positioning state of the screen plate reported by the reporting unit.

7. The screen printer of claim 1 further comprising:

a sensor provided at the work positioning mark on the workpiece for detecting the pointing element from the pointing unit; and a reporting unit for reporting a positioning state for the workpiece based on a signal from the sensor.

8. The screen printer of claim 7, wherein the pointing unit includes a moving mechanism for moving the pointing element based on the positioning state of the pointing element reported by the reporting unit.

9. The screen printer of claim 1, wherein the plate positioning mark on the screen plate is placed between the work positioning mark on the workpiece and the pointing element.

10. The screen printer of claim 1, wherein the pointing element is a beam of light positioned above the screenplate and workpiece.

11. A method for setting a screen plate comprising:

setting a workpiece at a printing position;

pointing a light beam at a work positioning mark on the workpiece; and setting a position of the screen plate to align a plate positioning mark on the screen plate with the light beam.

12. A screen printer comprising:

a table for placing a workpiece including a work positioning mark;

a pointing unit for aligning a pointing element with a work positioning mark provided on the workpiece placed on the table; and a fixing unit for fixing a screen plate including a plate positioning mark to be positioned for being aligned with the pointing element of the pointing unit aligned with the work positioning mark.

13. A screen printing apparatus for transferring designs from a screen plate to a workpiece, comprising:

a table on which the workpiece is positioned;

at least two positioning marks located on the screen plate and at least two work positioning marks located on the workpiece; and a pointing unit located above the screen plate and workpiece, providing at least two light beams as positioning pointers;

wherein the position of the screen plate and the workpiece are aligned with each other upon aligning the at least two light beams with the at least two positioning marks on the screen plate and the at least two work positioning marks on the workpiece.

14. A method for aligning a screen plate and a workpiece, comprising the steps of:

placing a workpiece on a table, the workpiece having at least two work positioning marks located thereon;

positioning a screen plate above the workpiece, the screen plate having at least two screen positioning marks located thereon;

positioning the at least two work positioning marks and the screen positioning marks so that corresponding work positioning marks and screen positioning marks are aligned with at least one of at least two light beams provided by a pointer unit located above the screen plate and workpiece.

15. A screen printer for performing screen printing by aligning positions of a workpiece and a screen plate, comprising:

a pointing unit aligning a light beam with a work positioning mark provided on a workpiece, wherein a plate positioning mark on the screen plate is positioned to be aligned with the light beam of the pointing unit once the work positioning mark has been aligned with the light beam, wherein the pointing unit shoots the light beam.

* * * * *